United States Patent [19]

Steinke

[11] Patent Number: 4,635,172

[45] Date of Patent: Jan. 6, 1987

[54] RECESSED LIGHTING FIXTURE HAVING THERMAL PROTECTION

[75] Inventor: Earl Steinke, Glen Ellyn, Ill.

[73] Assignee: Cooper Industries, Inc., Houston, Tex.

[21] Appl. No.: 710,282

[22] Filed: Mar. 4, 1985

[51] Int. Cl.[4] ..... F21V 21/29

[52] U.S. Cl. ..... 362/276; 362/294; 362/365; 362/364; 362/147

[58] Field of Search ..... 362/276, 183, 364, 147, 362/365, 373, 294; 337/113

[56] References Cited

U.S. PATENT DOCUMENTS

| | | | |
|---|---|---|---|
| 2,887,568 | 5/1959 | Franck | 362/147 |
| 4,039,822 | 8/1977 | Chan et al. | 362/183 |
| 4,216,411 | 8/1980 | Ehret et al. | 362/276 |
| 4,314,223 | 2/1982 | Kistofek | 337/113 |
| 4,450,512 | 5/1984 | Kristofek | 362/276 |

*Primary Examiner*—E. Rollins Cross

*Attorney, Agent, or Firm*—Eddie E. Scott; Alan R. Thiele

[57] ABSTRACT

An improved recessed lighting fixture of the type employing a separate incandescent light bulb socket enclosure substantially removed from the reflector of the fixture employing thermal protection is disclosed. The improvement comprises a thermal sensor and switch assembly mounted to the outer surface of the separate socket enclosure in close proximity to the outer surface and adjacent to the light socket and substantially removed from the reflector portion of the fixture. A protective enclosure is removeably mounted over the thermal sensor and switch assembly and the switch is connected in series with the power supply and socket so as to disconnect the socket from the power supply at a predetermined temperature as sensed by the sensor.

8 Claims, 3 Drawing Figures

RECESSED LIGHTING FIXTURE HAVING THERMAL PROTECTION

BACKGROUND OF THE INVENTION

This invention relates to recessed lighting fixtures. More particularly, the invention relates to recessed lighting fixtures of the type including an incandescent lamp socket enclosure forming a separate portion of the fixture that is substantially displaced from the reflector and other housing portions of the fixture. In still greater particularity, the invention relates to an improvement in these type lighting fixtures providing protection from overheating.

It is becoming increasingly common in the design of recessed lighting fixtures to provide for protection against fire due to fixture overheating. For example, U.S. Pat. Nos. 4,314,223 and 4,450,512 to Paul Kristofek and assigned to the same assignee as the present application disclose a thermal protective device for disconnecting a lamp socket from the power supply when the temperature of the fixture reaches a predetermined level. In U.S. Pat. No. 4,314,223 the thermal protective device is suspended within the interior of the fixture housing between the lamp and the inner surface of the housing wall, and in U.S. Pat. No. 4,450,512, the protective device is mounted on the inner surface of the housing wall to sense the temperature on the outer surface of the housing wall. These structures are effective in protecting recessed fixtures of the type wherein the light source is mounted within the housing or reflector. In such cases the heat generated by both the lamp and the generated within the lamp socket is concentrated and contained within the housing and reflector of the fixture. Therefore, for the most part, substantially all of the sources of heat are monitored. These structures are, however, not able to provide for proper monitoring of heat in those application wherein the sources of heat generated are substantially separated and confined to separate areas such as recessed fixtures incorporating a separate enclosure or neck mounted to and extending from the main housng and reflector and within which the socket for holding the light bulb is mounted. In these type fixtures, heat generated by the bulb is generated within the main housing and reflector and in general is reflected by the reflector out of the housing or at least has greater opportunity to be circulated and safely dissipated. To the contrary, fixtures incorporating a separate socket enclosure isolated from the main housing have less opportunity to dissipate heat generated therein, for example the heat generated by the light socket, because these enclosures are relatively small. The heat generated within these separate enclosures has less opportunity to escape and they can operate at considerably higher temperatures than the main housing. There is, therefore, a need to provide for protection against overheating of those fixtures of the type experiencing two zones of heat concentration.

SUMMARY OF THE INVENTION

Accordingly, it is an object of the present invention to provide for thermal protection of a recessed light fixture of the type including a separate lamp socket enclosure substantially divorced from the main enclosure as defined by the reflector.

The preferred aspect of the invention provides for mounting a thermal sensor in close proximity to the outer surface of the separate lamp socket enclosure adjacent to the lamp socket and substantially removed from the reflector portion of the fixture.

According to another feature of the invention, a protective enclosure is mounted to the outer surface of the separate lamp socket enclosure over an integral heat sensor-electrical switch assembly which is positioned adjacent the outer surface of the socket enclosure and which is connected in series with a power supply and the lamp socket.

BRIEF DESCRIPTION OF THE DRAWINGS

The invention will become better understood after reading the following detailed description in conjunction with the drawings wherein.

DETAILED DESCRIPTION OF THE PREFERRED EMBODIMENT

Figure 1:
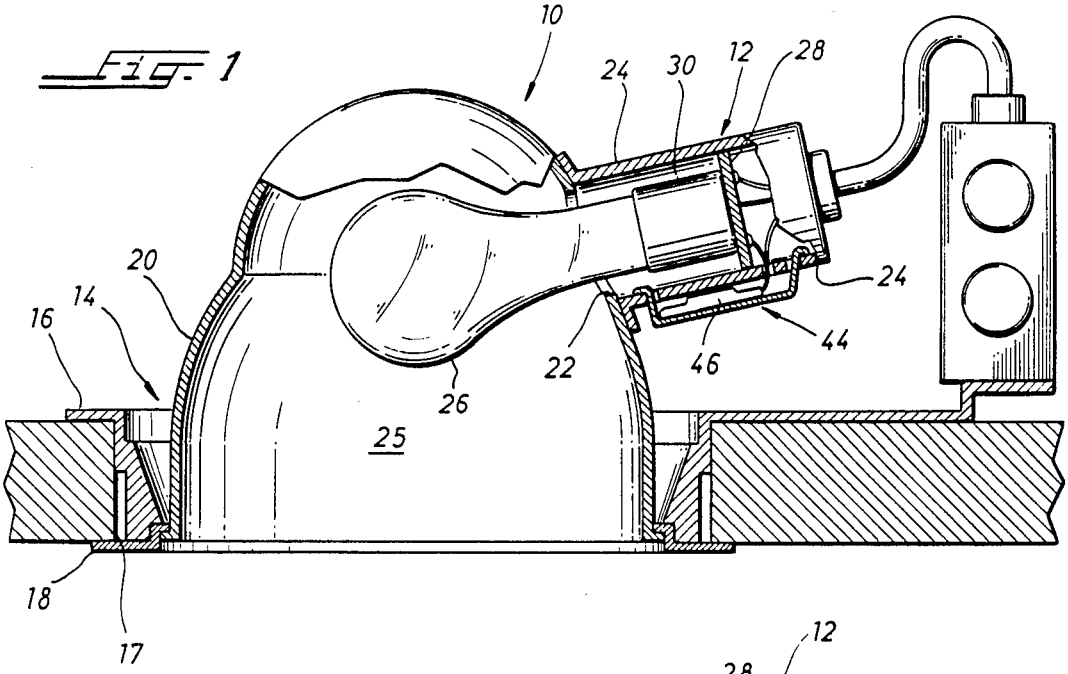
FIG. 1 is a vertical cross-sectional view of a recessed lighting fixture of the type having a separate neck portion within which a lamp socket is mounted employing the principals of the present invention.
Figure 2:
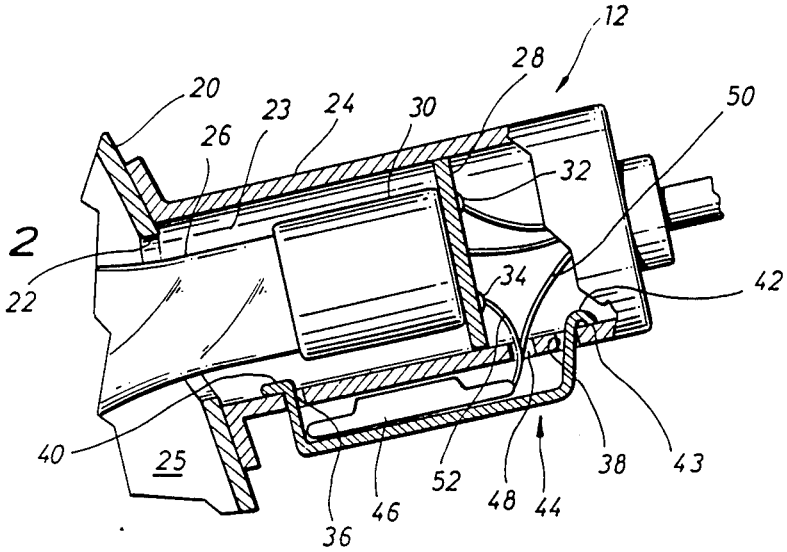
FIG. 2 is an enlarged cut-away portion in partial cross-section of the neck portion of the fixture in FIG. 1 showing details of construction.

Shown in FIG. 1, is a typical recessed lighting fixture 10 of the type including a separate incandescent light bulb socket enclosure 12. The fixture 10 comprises a frame 14 in the form of a plaster frame ring 16 which is configured to be mounted in a complementary opening 17 usually in a ceiling. A trim ring 18 fits into the frame and decoratively finishes the installation. A reflector 20 is mounted within and extends above the frame 16. As shown in FIGS. 1 and 2, the reflector 20 is provided with a clearance opening 22 in one side over which the light socket enclosure 12 in the form of a generally elongated neck 24 is mounted laterally to one side of the reflector. The clearance opening 22 provides for access to the interior of the neck, and it can be seen that when a light bulb 26 is mounted as set out below, two separate substantially displaced interior volumes 23, 25 are defined: one 23 defined by the interior of the neck enclosure 24 and a second 25 defined by the interior of the reflector 20.

As best shown in FIG. 2, the neck is provided with a transverse wall 28 to which an incandescent lamp socket 30 is mounted, for example, by a pair of screws 32, 34. The wall 28 is positioned such that the light emitting portion of the bulb is positioned centrally within the reflector when the bulb is engaged in the socket.

Still referring to FIG. 2, the outer wall of the neck 24 is provided with a pair of apertures 36, 38 into which a pair of tabs 40, 42 on a protective enclosure 44 are received. The protective enclosure is configured to receive therein a thermal sensor and an electrical switch assembly 46. The thermal sensor-switch assembly is retained by the protective enclosure in close proximity to the outer surface of the socket enclosure preferably at a location adjacent the socket and substantially removed from the reflector portion of the fixture so as to sense the temperature at the outer surface of the socket enclosure at the location most likely to experience the highest temperature in operation. To facilitate removal and installation of the protective enclosure, so that the sensor can be serviced, one tab, such as 42 is a spring tab which biases the enclosure toward the reflector end of the neck and which is easily disengaged from the aperture 38 by pushing the tab toward the reflector to align the free end 43 with the aperture 38, whereby the protective enclosure can be pulled down away from the neck. Conversely, installation is achieved by pushing the tab 42 into the aperture 38 allowing the free end 43 to snap into engagement with inner surface of the neck.

Those skilled in the art can readily devise other means for retaining the sensor and switch assembly to the socket enclosure and the invention is not to be considered limited to that shown.

The outer wall of the neck 24 is provided with an access hole 48 intermediate the apertures 36, 38 providing for passage of a pair of electrical leads 50, 52 from the sensor-switch assembly to the power supply leads and socket. The switch is connected in series with the power supply and socket and is responsive to open the electrical circuit at a predetermined temperature as sensed by the heat sensor and to close the circuit when the temperature at the neck is lower than the predetermined temperature level.

Figure 3:
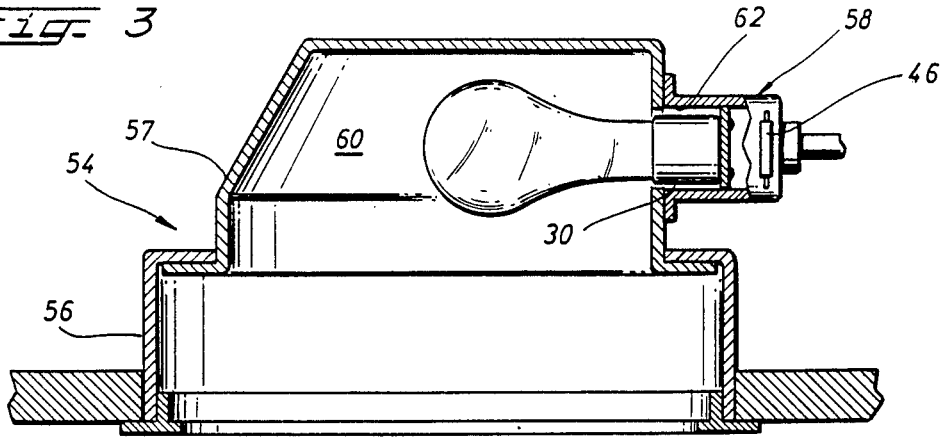
FIG. 3 is a vertical cross sectional view of another recessed lighting fixture of the type having a separate lamp socket enclosure employing the principles of the present invention.

Now referring to FIG. 3, there is shown another recessed light fixture 54 including a frame 56 over which a reflector 57 is mounted. A light socket enclosure 58 similar to the neck type enclosure shown in FIG. 1 is provided in this fixture and is typically positioned to one side of the reflector. The light socket 30 is mounted within the enclosure 58 such that the incandescent bulb 26 is positioned within the reflector thereby forming two separate interior volumes 60, 62: one 60 defined by the interior of the reflector and one 62 defined by the interior of the socket enclosure. As with the structure of the fixture of FIG. 1, greater heat can build up in the socket enclosure interior 62 than within the reflector interior 60. Thermal protection is provided by mounting the thermal sensor-switch assembly 46 to an outer surface of the socket enclosure 58 in close proximity to the socket but substantially removed from the reflector portion 57, as shown in FIG. 3.

Fixtures employing the principles of the present invention afford protection against overheating due to heat build up within the interior of the separate socket enclosures thereby providing for safer operation.

Having described the preferred embodiment of the present invention those skilled in the art, having the benefit of said description and the accompanying drawings, can readily devise other embodiments and modifications. Therefore, said other embodiments and modifications are to be considered to be within the scope of the appended claims.

I claim:

1. A recessed lighting fixture of the type including a frame adapted to be mounted in an opening in a ceiling, a light reflector mounted to said frame defining a first interior volume and including a neck portion extending from said reflector defining a second interior volume substantially separate from said first interior volume, an incandescent light bulb socket mounted within said neck, second interior volume, said socket adapted to be electrically coupled to a power supply wherein the improvement in the fixture comprises:

heat sensor means mounted in close proximity to an outer surface of said neck adjacent said socket; and electrical switch means connected in series with said power source in said socket and being operatively associated with said heat sensor means for disconnecting said power source from said socket when said heat sensor means reaches a predetermined temperature.

2. A recessed lighting fixture of the type including a frame adapted to be mounted in an opening in a ceiling, a reflector mounted above said frame defining a first space and provided with a clearance opening in a side portion thereof, a light socket enclosure member mounted to said reflector over said clearance opening defining a second space substantially displaced from said first space of said reflector, an incandescent light socket mounted within said second space of said enclosure adapted to be electrically coupled to a power source and to position the light emitting portion of an incandescent bulb through said clearance opening adjacent said reflector wherein the improvement comprises:

a thermal sensor mounted in close proximity to an outer surface of said socket enclosure adjacent said socket therein, said sensor including an electrical switch connected in series with said power source and said socket; said switch being operatively responsive to said thermal sensor to disconnect said socket from said power source when said thermal sensor reaches a predetermined temperature; and a protective enclosure mounted around said thermal sensor and said switch, said protective enclosure being removably mounted to said socket enclosure.

3. The fixture as defined in claim 2 wherein said sensor and said switch are an integral assembly.

4. A fixture as defined in claim 2 wherein said sensor is positioned at a predetermined location on said socket enclosure substantially removed from said reflector.

5. A recessed lighting fixture of the type including a frame configured to be mounted in an opening in a ceiling, a light reflector mounted to said frame forming a first interior volume, a light socket enclosure extending from said reflector forming a second interior volume substantially displaced from said first interior volume, said enclosure including means for mounting an incandescent light socket therein, said light socket adapted to be coupled to a power supply wherein the improvement comprises:

heat responsive sensor means mounted in close proximity to an outer surface of socket enclosure at a predetermined location adjacent said light socket substantially removed from said reflector first interior volume;

switch means operatively associated with said sensor electrically connected in series with said power source and said socket adapted to open and disconnect said socket from said power supply when said sensor means reaches a predetermined temperature; and a protective enclosure removably mounted to said outer surface of said socket enclosure around said sensor.

6. The fixture as defined in claim 5 wherein said switch and said sensor are a one-piece integral assembly.

7. The fixture as defined in claim 6 wherein said protective enclosure includes at least two tabs received in a pair of spaced apart apertures in said socket enclosure, said protective enclosure retains said switch and sensor assembly against the outer wall of said socket enclosure.

8. The fixture as defined in claim 7 wherein one of said tabs defines a spring resiliently retained in one of said apertures.

* * * * *